US005088437A

United States Patent [19]

Harper, Jr.

[11] Patent Number: 5,088,437

[45] Date of Patent: Feb. 18, 1992

[54] BOAT HULL CONSTRUCTION METHOD AND PRODUCT THEREOF

[76] Inventor: William H. Harper, Jr., 1454 Amon Dr., Richland, Wash. 99352

[21] Appl. No.: 521,244

[22] Filed: May 9, 1990

[51] Int. Cl.[5] ..... B63B 3/00

[52] U.S. Cl. ..... 114/355

[58] Field of Search ..... 114/77 R, 77 A, 79 R, 114/79 W, 82, 83, 56, 355-359, 352-354; D12/313

[56] References Cited

U.S. PATENT DOCUMENTS

| | | | |
|---|---|---|---|
| D. 286,729 | 10/1986 | Maher | D12/313 |
| 926,252 | 6/1909 | Hyde | 114/356 |
| 2,328,437 | 8/1943 | Elling | 114/356 |
| 2,461,819 | 2/1949 | Hall | 114/356 |
| 2,515,161 | 7/1950 | Hall | 114/356 |
| 2,515,162 | 7/1950 | Hall | 114/356 |
| 2,546,955 | 3/1951 | Ventura | 114/356 |
| 2,917,754 | 12/1959 | Gunderson | D12/304 |
| 3,561,388 | 2/1971 | Keiper | D12/304 |

FOREIGN PATENT DOCUMENTS

| | | | |
|---|---|---|---|
| 1199658 | 7/1970 | United Kingdom | 114/355 |

*Primary Examiner*—Jesus D. Sotelo

*Attorney, Agent, or Firm*—Cahill, Sutton & Thomas

[57] ABSTRACT

A deck, gunnel, and two longitudinal hull plates, each having one longitudinal straight edge, are serially attached to one another with two interposed longitudinal bulkheads. After attachment of the gunnel straight edge to the curved edge of the deck, the deck is set at 45° to horizontal to define the curved edge of the vertically positioned first longitudinal bulkhead by scribing a horizontal extension of the curved gunnel edge. The straight edge of the first longitudinal hull plate is secured to the curved edge of the first longitudinal bulkhead and the opposite edge is trimmed and secured to the curved edge of the gunnel. After placing the deck horizontally, the curved edge of the vertically extending second longitudinal bulkhead is scribed as a horizontal extension of the curved edge of the first longitudinal bulkhead. The straight edge of the second longitudinal hull plate is secured to the curved edge of the second longitudinal bulkhead and the opposite edge is trimmed and secured to the curved edge of the first longitudinal bulkhead. Upon adding a stern bulkhead, a pontoon of a catamaran or one half of a boat hull will have been formed. The second boat hull half may be a mirror image of the first boat hull half and the two halves may be attached to one another with or without a spacer to form a full hull.

26 Claims, 3 Drawing Sheets

BOAT HULL CONSTRUCTION METHOD AND PRODUCT THEREOF

BACKGROUND OF THE INVENTION

1. Field of the Invention

The present invention relates to boat hull construction methods and, more particularly, to a method for defining the configuration of the hull components during actual construction.

2. Description of the Prior Art

The first water borne craft, commonly known as dugouts, were constructed without plans and the configuration evolved as part of the construction. Thereafter, more and more complicated vessels were designed and built. These vessels required extensive drafting to define innumerable exterior and interior views, cross sections, framework and curvature of covering material. Innumerable details attendant support plates, reinforcements and attachment means were mandatory. As part of the drafting procedure, patterns of certain parts have to be created and time consuming projections must be developed. For many types of boats there has to be lofting of major components. Thus, the preparatory work necessary before construction of a vessel can even begin has become almost insurmountable. When compound curves are involved, the complexity of the drafting requirements and manufacturing processes for individual parts and assembly are exacerbated.

SUMMARY OF THE INVENTION

After the planform of a deck for a boat hull having a straight longitudinal edge and a curved longitudinal edge is determined, a straight edge of a gunnel is attached along the curved edge at a right angle to the deck. The deck is rotated about its straight edge to an angle of 45°. A vertically positioned longitudinal bulkhead is attached along its straight edge to the straight edge of the deck. A first line, formed by a horizontal projection from the free gunnel edge, is scribed on the first bulkhead to define its curved edge. A straight edge of a first longitudinal hull plate is attached to the curved first bulkhead edge to extend across and rest upon the free edge of the gunnel; it is trimmed along the gunnel free edge and attached thereto. The deck is rotated further to the horizontal position and a vertically oriented second longitudinal bulkhead is attached along its straight edge to the straight edge of the deck. A second line, formed by a horizontal projection from the curved edge of the first bulkhead, is scribed on the second bulkhead to define its curved edge. A straight edge of a second longitudinal hull plate is attached to the curved edge of the second bulkhead to extend across and rest upon the curved edge of the first bulkhead; it is trimmed along the curved edge of the first bulkhead and attached thereto. Upon attachment of a stern bulkhead, the structure may be used as a pontoon for a catamaran. Two mirror image hulls may be attached by joining the second bulkheads face to face to form a full hull; alternatively, a hollow spacer may be disposed between the hulls to widen the vessel for more cargo volume. The spacer may extend for the full depth of the hull or it may be of lesser depth and define a catamaran type hull.

It is therefore an object of the present invention to define with simple tools the configuration of the hull plates and supporting internal bulkheads of a hull simultaneously with construction of the hull.

Another object of the present invention is to provide a method for constructing a hull by defining all curved edges of hull plates and support structures to be attached to a preformed deck during construction of the hull.

Still another object of the present invention is to provide a method for defining the configuration of a plurality of single curvature hull plates to be joined to one another edge to edge during construction of a hull.

Yet another object of the present invention is to provide a method for scribing curved edges of components of a hull by using horizontal projections extending from a previously attached hull member.

A further object of the present invention is to provide a simple and inexpensive method for constructing a hull of any size.

A still further object of the present invention is to provide a method which eliminates the need for laborious drafting efforts in order to construct a hull of any desired size.

A yet further object of the present invention is to provide a hull constructed from sheet material in accordance with a simplified hull assembly procedure.

A yet further object of the present invention is to provide a method for constructing a hull having a plurality of flat and single curvature plates to form the hull configuration.

These and other objects of the present invention will become apparent to those skilled in the art as the description thereof proceeds.

BRIEF DESCRIPTION OF THE INVENTION

The present invention will be described with greater clarity and specificity with reference to the following drawings, in which.

DESCRIPTION OF THE PREFERRED EMBODIMENT

Figures 1, 2:
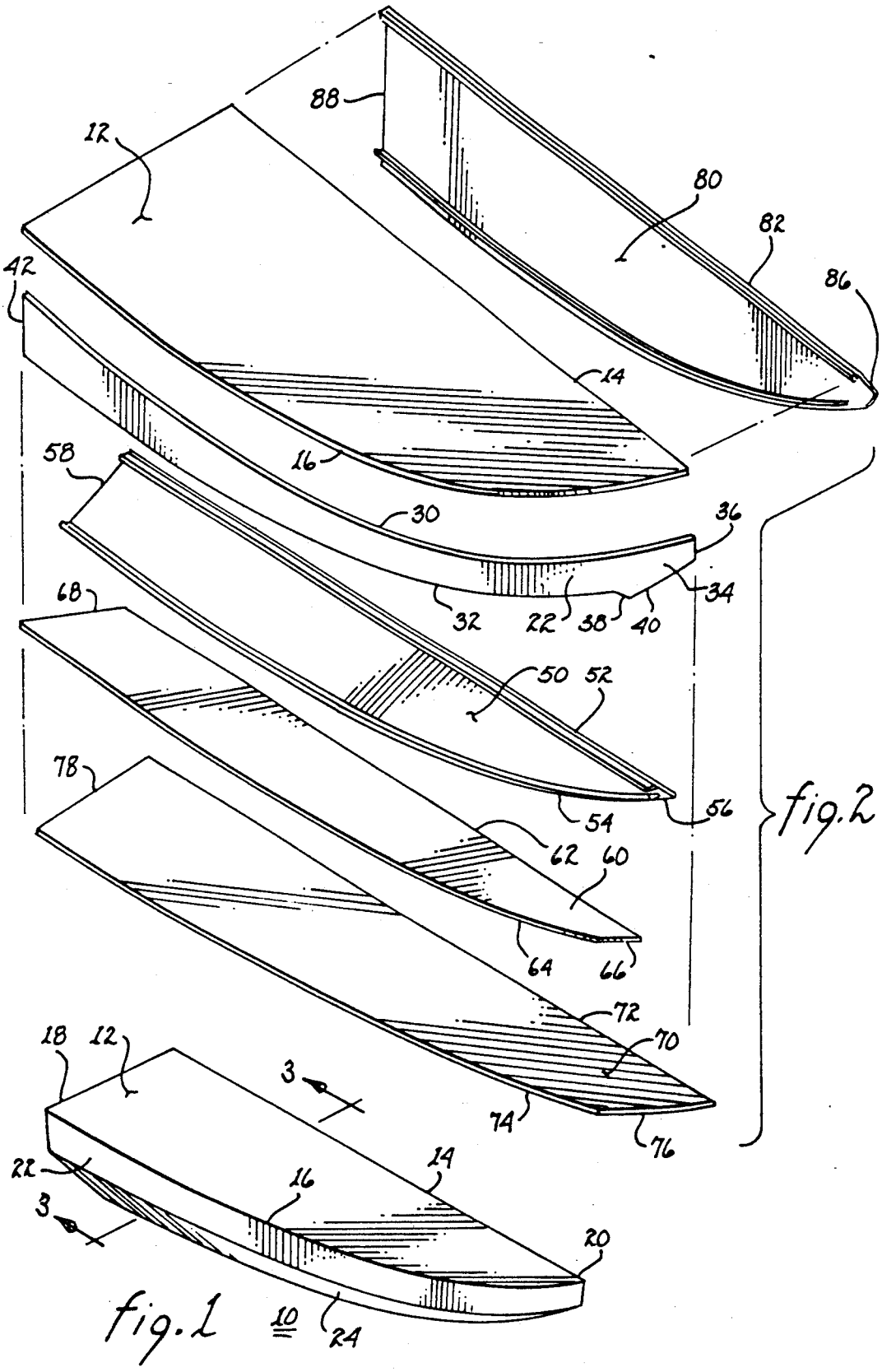
FIG. 1 is an isometric view of a hull constructed in accordance with the method described herein.
FIG. 2 is an exploded view of the primary components for constructing the hull shown in FIG. 1.

Referring to FIG. 1, there is illustrated a hull 10 constructed in accordance with the teachings of the present invention. The hull includes a deck plate 12 having a straight longitudinal edge 14 and a curved edge 16 defining a curved side of the hull. The stern may include a straight edge 18. The bow is defined by a point 20. A gunnel 22 depends from curved edge 16. A first longitudinal hull plate 24 depends from the lower edge of gunnel 22. A keel or longitudinal bulkhead (not shown) extends downwardly from straight edge 14. A second longitudinal hull plate (not shown) interconnects the lower edge of plate 24 with the lower edge of the bulkhead. A stern bulkhead depends from stern edge 18 to close the stern of hull 10. The stern bulkhead may be perpendicular to deck 12 or slanted.

Referring to FIG. 2, a further description of the major components assembled in accordance with the present method to define hull 10 will be described. Curved edge 16 of deck 12 is shaped in accordance with a naval architect's artistic preference or in response to volumetric and load carrying capabilities or a combination thereof. A hull plate or gunnel 22, in planform, includes a longitudinal edge 30 which is straight and a further longitudinal edge 32 which may be parallel with edge 30, tapered or curved. Bow end 34 of the gunnel includes a straight edge 36, the length of which is a function of the naval architect's preference with respect to the depth of the freeboard at the bow. The bow end of the gunnel may include an edge 38 slanting downwardly from edge 32 to provide a more structurally robust means for attaching the adjacent longitudinal hull plate. Edge 40 interconnects edges 38 and 36. Edge 42 at the stern of gunnel 22 may be perpendicular to edge 30 or slanted, depending upon the degree of slope desired for the stern bulkhead.

A first longitudinal bulkhead 50 includes a longitudinal straight edge 52 and a curved longitudinal edge 54, the curvature of which is determined during construction of hull 10. The bow of first bulkhead 50 includes a straight edge 56 interconnecting edge 52 and edge 5 and bears against the inner surface of bow end 34 of gunnel 2. Edge 58 at the stern of bulkhead 50 may be perpendicular to edge 52 or slanted, depending upon the orientation of the stern bulkhead. A first longitudinal hull plate 60 includes a longitudinal straight edge 62 and a curved edge 64, the curvature of which is determined during construction. The bow of first hull plate 60 includes a straight edge 66 interconnecting edges 62 and 64 and is of a length commensurate with edge 38 of gunnel 22. Stern edge 68 may be perpendicular to edge 62 or slanted, depending upon the orientation of the stern bulkhead.

Second longitudinal hull plate 70 includes a longitudinal straight edge 72 and a curved edge 74, the curvature of which is determined during construction. Edge 76 is commensurate in length and curvature with edge 40 of gunnel 22; the curvature of this edge is determined during construction. Stern edge 78 may be straight or angled, depending upon the orientation of the stern bulkhead. A second longitudinal bulkhead 80 includes a straight longitudinal edge 82 and a curved longitudinal edge 84, the curvature of which is determined during construction. Edge 86 at the bow is commensurate in length with edge 36 of gunnel 22. The length of stern edge 88 is determined during construction and its angle is a function of the angle of the stern bulkhead to be used.

Figure 3:
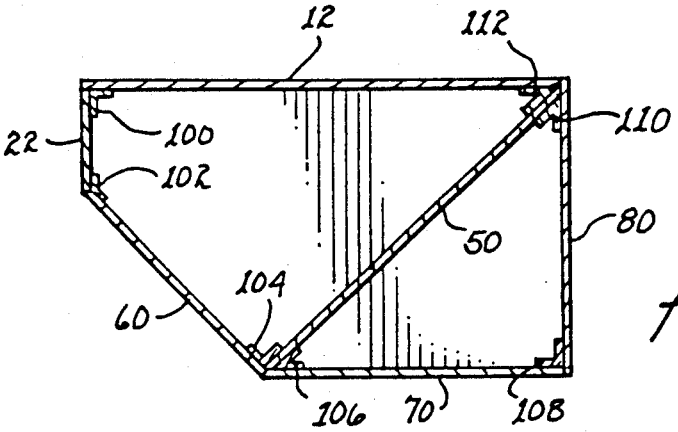
FIG. 3 is a cross sectional view taken along lines 3—3, as shown in FIG. 1, and illustrating attachment of the various components.
Figure 4:
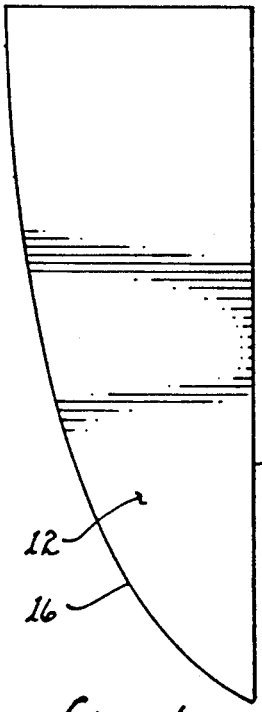
FIG. 4 illustrates a representative deck planform.

As will be described with reference to FIG. 3, various gussets and angles may be employed to strengthen the junctions of the various components. A right angle gusset 100 may extend for the length of the junction between deck 12 and gunnel 22 or a plurality of individual gussets may be employed. A gusset 102 may extend for the length of the junction between gunnel 22 and first longitudinal hull plate 60 or a plurality of individual gussets may be employe to provide the requisite strength and robustness. A right angle gusset 104 is disposed to strengthen the junction between first longitudinal hull plate 60 and first longitudinal bulkhead 50. This gusset may extend throughout the length of the junction or a plurality of spaced gussets may be employed. A gusset 106 is disposed between the junction of first longitudinal bulkhead 50 and second longitudinal hull plate 70, which gusset may extend throughout the junction or be segmented therealong. A right angle gusset 108 is employed to strengthen the junction between second longitudinal hull plate 70 and second longitudinal bulkhead 80. This gusset may be continuous or segmented. A gusset 110 is disposed at the junction of second longitudinal bulkhead 80 and first longitudinal bulkhead 50 to strengthen the junction therebetween. This gusset may extend continuously or be segmented. A gusset 112 is disposed between first longitudinal bulkhead 50 and deck 12 to strengthen the junction therebetween. This gusset may be continuous or segmented.

Figure 5:
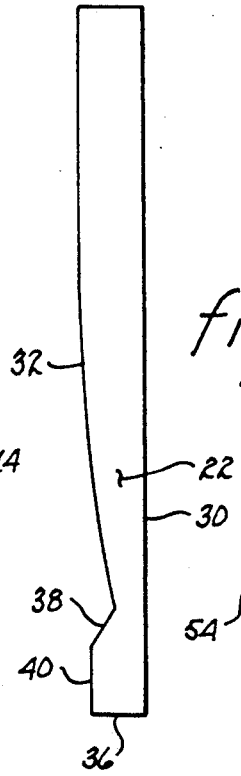
FIG. 5 illustrates a representative gunnel planform.

The method for constructing hull 10 will be described with joint reference to FIGS. 5, 6 and 7. First, deck 12 may be formed with a longitudinal straight edge 14 defining the length of the hull. The curvature of edge 16 is a function of the width of the hull desired along with consideration for the cargo space and aesthetic considerations. Gunnel 22 is formed with a longitudinal straight edge 30. Edge 32 is straight or curved as a function aesthetics and the height of the freeboard desired. The length of edge 38 is not critical and is primarily a consideration of the bluntness preferred for the bow end of first longitudinal hull plate 60 to permit facile attachment with the gunnel and to provide the requisite structural strength. Similar considerations are attendant the length of straight edge 40. The length of edge 36 is a function of the height of the vertical bow desired. After the deck and gunnel have been fabricated, construction may begin.

Deck 12 is laid upon a horizontal surface. Edge 32 of gunnel 22 is wrapped around curved edge 16 of the deck and the edge of the gunnel is secured to the curved edge of the deck. Because of the resulting single curvature of the gunnel, it will extend perpendicularly from the deck. As part of the attachment procedure, gusset 100 (see FIG. 3) may be attached to more rigidly secure the gunnel with the deck. It may be noted that during this attachment procedure, little in the way of jigs, fixtures or other alignment mechanisms need be employed.

Figure 6:
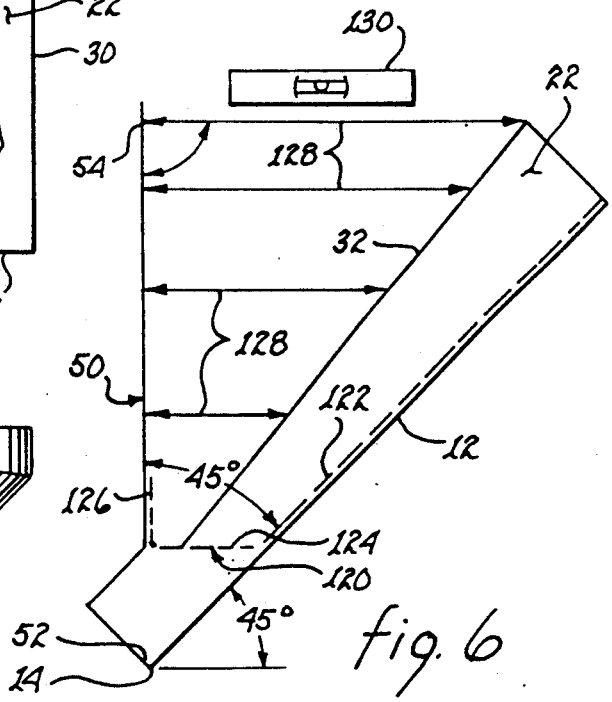
FIG. 6 illustrates the first step in defining the shape of the first longitudinal bulkhead and the first longitudinal hull plate.

After attachment of the gunnel, deck 12 is rotated about longitudinal edge 14 to position it at an angle of 45° with respect to a horizontal surface, as illustrated in FIG. 6. A jig or fixture 120, illustrated by dashed lines in FIG. 6, includes a first flange 122 set at an angle of 45° with respect to base 124 and a second flange 126 set at an angle of 90° with respect to the base. Flange 122 is placed adjacent the inside surface of deck 20 and positioned therealong until flange 126 is in vertical alignment with edge 14. First longitudinal bulkhead 50 is positioned with its longitudinal straight edge 52 adjacent longitudinal straight edge 14. The first longitudinal bulkhead extends vertically upwardly in contacting relationship with flange 126, which flange stabilizes the first longitudinal bulkhead.

To determine the point of attachment of first longitudinal hull plate 60 with first longitudinal bulkhead 50 and the curvature of line 54, edge 32 of gunnel 22 is projected horizontally onto the surface of first longitudinal bulkhead 50, as depicted by arrows 128. To ensure accurate horizontal projection, a level, such as level 130, may be employed. Other projection means, such as lasers, lights or mechanical implements can be similarly employed. The line projected by edge 32 of gunnel 22 is scribed upon first longitudinal bulkhead 50 and the bulkhead is cut along this line to define edge 54.

After edge 54 of longitudinal bulkhead 50 has been cut, edge 52 may be attached to edge 14 of deck 12 and edge 56 is attached to the interior surface of bow end 34 of the gunnel. First longitudinal hull plate 60, having longitudinal edge 62 cut therein but not curved edge 64 or edge 66, is mounted to rest upon edge 54 of first longitudinal bulkhead 50 and edge 32 of gunnel 22. The plate is wrapped around these edges and it will become apparent that the plate will be curved with a single curvature. First longitudinal hull plate 60 is located to mate or match its first longitudinal edge 62 with curved edge 54 of first longitudinal bulkhead 50. The line of contact between edge 32 of gunnel 22 and the first longitudinal hull plate is scribed upon the plate and will become curved edge 64 and straight edge 66. The first longitudinal hull plate is thereafter cut to form edges 64 and 66. The first longitudinal hull plate may now be attached to the corresponding and mating edges. Prior to such attachment, gussets 102 and 104 (see FIG. 3) may be mounted in place to provide additional stability and strength at the junction of the intersecting edges. Prior to attachment of first longitudinal hull plate 60, fixture 120 may be removed.

Figure 7:
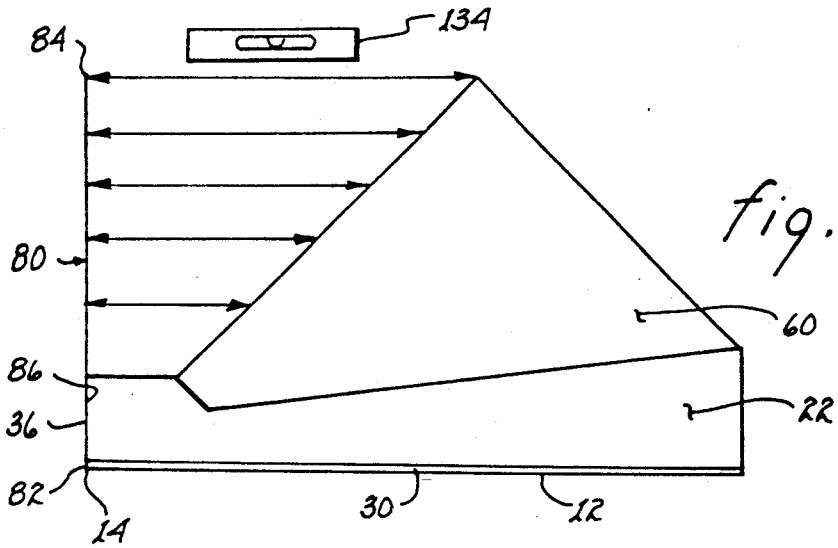
FIG. 7 illustrates the step for defining the second longitudinal bulkhead and the second longitudinal hull plate.

After attachment of first longitudinal hull plate 60, deck 12 is placed on a horizontal surface, as depicted in FIG. 7. Longitudinal straight edge 82 of second longitudinal bulkhead 80 is placed adjacent straight edge 14 of deck 12 and straight edge 52 of the first longitudinal bulkhead and the second longitudinal bulkhead is oriented to extend vertically upwardly from the deck. Edge 86 at the bow of the second longitudinal bulkhead is cut to be coincident with edge 36 of gunnel 22. Edge 36 can also serve the function of vertically aligning the second longitudinal bulkhead since this edge is perpendicular to the deck and straight edge 30 of the gunnel.

Curved edge 84 of second longitudinal bulkhead 80 is developed by projecting edge 64 of first longitudinal hull plate 60 horizontally and scribing a line upon the second longitudinal bulkhead in accordance with the projection. The projection of the line is representatively depicted by arrows 132 and their horizontal alignment is depicted by level 134. To scribe the line, an actual level may be used, which level would rest upon edge 64. Other means, such as lasers, lights and mechanical implements could also be used. Thereafter, edge 84 is cut in conformance with the scribed line. Second longitudinal bulkhead 80 may now be attached to the assembly by attaching edge 82 with edge 14 of the deck and/or with edge 52 of the first longitudinal bulkhead.

Second longitudinal hull plate 70 is placed upon edges 84,64 with edge 72 being coincident with edge 84. Curved edge 74 of the second longitudinal hull plate is determined by the intersection between second longitudinal hull plate 70 and edge 64 of first longitudinal hull plate 60. This line is scribed upon the second longitudinal hull plate. Similarly, the intersection between edge 40 of gunnel 22 and the second longitudinal hull plate is scribed to define edge 76 of the second longitudinal hull plate. Thereafter, the second longitudinal hull plate is cut along the scribed lines to define edges 74 and 76. After second longitudinal hull plate 70 has been cut, it may be attached to edges 54,64,84 and 40 of first longitudinal bulkhead 50, first longitudinal hull plate 60 and gunnel 22, respectively. Prior to such attachment, gussets 106,108 and 110 (see FIG. 3) may be installed to augment the strength of the respective junctions.

The stern bulkhead, not shown, may now be attached after the stern edges of the respective bulkheads and hull plates have been cut at an angle commensurate with the desired orientation of the stern bulkhead.

At this point in construction, a hull configured as depicted in FIG. 1 will have been formed. This hull may be considered as a pontoon or a half hull.

After assembly of the hull, the first and second longitudinal bulkheads may be apertured or otherwise have spaces formed therein for purposes of accommodating cargo, living quarters, propulsion units, etc. to be located and mounted within the hull. Additional vertical and horizontal bulkheads may be added as necessary to define compartments, cargo bays, cabins, etc.

Figure 8:
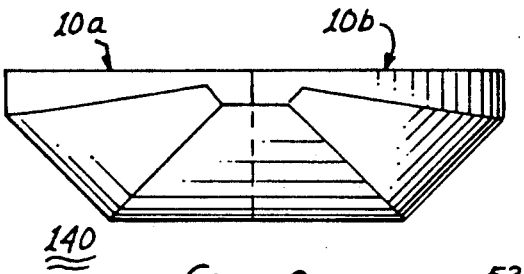
FIG. 8 illustrates a representative hull formed by joining two mirror image hulls with one another.

Referring to FIG. 8, there is depicted a vessel 140 having a pair of mirror image hulls 10*a*,10*b* joined to one another along their respective second longitudinal bulkheads. To increase the width of vessel 140 to form a barge or the like, a spacer may be disposed between hulls 10*a*,10*b* with a cross section commensurate with that of the second longitudinal bulkhead. The width of the spacer would be a function of the amount of volume desired.

Figure 9:
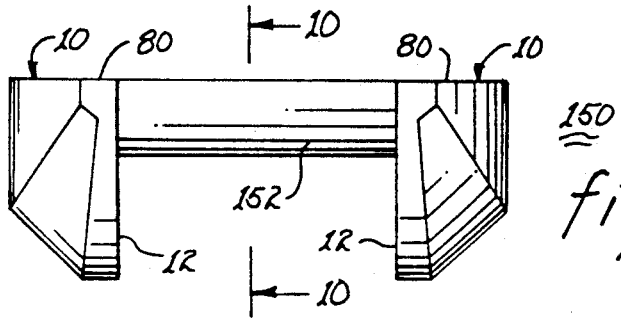
FIG. 9 illustrates a representative hull formed by placing a spacer intermediate two representative hulls.
Figure 10:
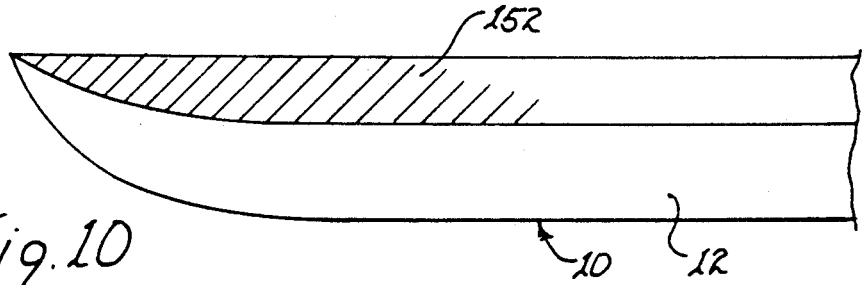
FIG. 10 is a cross sectional view taken along lines 10—10, as shown in FIG. 9.

As illustrated in FIGS. 9 and 10, a catamaran type vessel 150 may be built from a pair of hulls 10. In the orientation shown in FIG. 9, hulls 10 have been rotated 90° about their longitudinal axis to orient deck 1 vertically and second longitudinal bulkheads 80 horizontally. The resulting hull configuration is better adapted for use as the pontoons of a catamaran or the like. A spacer 152 having less depth than that of the hulls may be disposed between the hulls for cargo carrying purposes.

Figure 11:
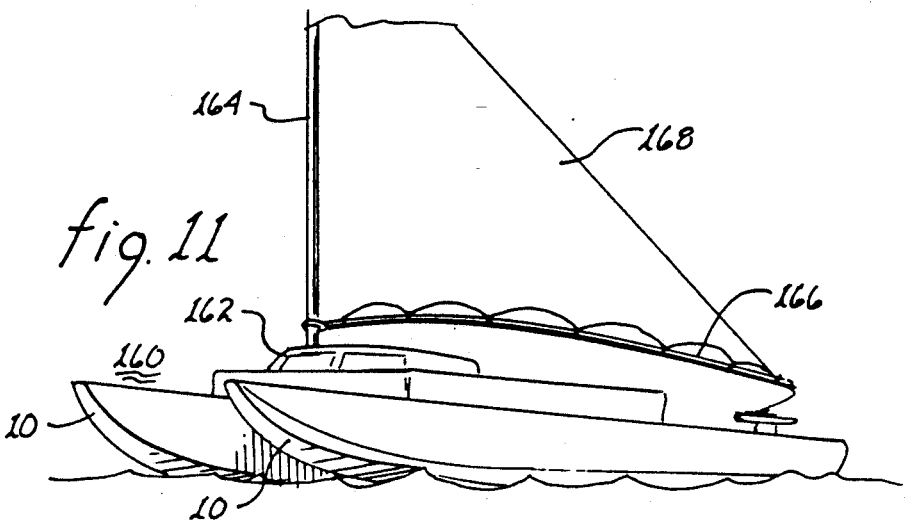
FIG. 11 illustrates a fully constructed catamaran having hulls constructed in accordance with the present method.

A catamaran 160 built in accordance with these teachings is illustrated in FIG. 11. This catamaran has had added thereto super structure 162 to define a cabin extending upwardly from spacer 152. Additionally, a mast 164 and boom !66 has been added to support a sail 168. The necessary shrouds and guy lines (not shown) would be added, as is conventional.

In the preferred embodiment described above, the deck included a straight edge for ease in rotating the deck to attach the bulkheads and hull plates. However, a deck having opposed curved longitudinal edges equidistant from a straight center line could also be used. With such embodiment of the deck, it would be rotated about its center line to form and attach the hull plates and bulkheads described above. Moreover, the formation and attachment could proceed from one curved edge to the mid point and then from the other edge to the mid point. Alternatively, the hull plates and bulkheads could be serially formed and attached from one curved edge of the deck to the other curved edge in accordance with the method described above.

From the above discussion, it will become apparent that the hull construction process or method described above is well adapted to constructing, relatively inexpensively, one of a kind hulls since none of the normally required drafting work and extraordinary calculations usually faced by naval architects need be undertaken. Moreover, little more is needed than that of providing a horizontal surface, angle jigs and a level along with the necessary tools or apparatus to cut and to secure the bulkheads and hull plates to one another.

While the principles of the invention have now been made clear in an illustrative embodiment, there will be immediately obvious to those skilled in the art many modifications of structure, arrangement, proportions, elements, materials and components used in the practice of the invention which are particularly adapted for specific environments and operating requirements without departing from those principles.

I claim:

1. A method for constructing a boat hull, said method comprising the steps of:

a) fabricating a deck having one straight longitudinal edge and a curved longitudinal edge;

b) forming a gunnel having a first straight longitudinal edge and a second longitudinal edge;

c) attaching the straight longitudinal edge of the gunnel to the curved longitudinal edge of the deck;

d) rotating the deck about its straight longitudinal edge disposed in a first plane to an angle of 45° with respect to the first plane;

e) attaching a straight longitudinal edge of a first longitudinal bulkhead to the straight longitudinal edge of the deck to locate the first bulkhead in a second plane perpendicular to the first plane;

f) projecting a first scribe line upon the first bulkhead from the second edge of the gunnel parallel with the first plane;

g) cutting the first bulkhead along the first scribe line to develop a curved edge of the first bulkhead;

h) locating a straight longitudinal edge of a first hull plate coincident with the curved edge of the first bulkhead and resting the first hull plate upon the second edge of the gunnel;

i) cutting the first hull plate in proximity to its line of contact with the second edge of the gunnel;

j) attaching the first hull plate to the curved edge of the first bulkhead and to the second edge of the gunnel;

k) rotating the deck about its straight longitudinal edge disposed in the first plane to a position coincident with the first plane;

l) attaching a straight longitudinal edge of a second longitudinal bulkhead to the straight longitudinal edge of the deck to locate the second bulkhead in a second plane perpendicular to the first plane;

m) projecting a second scribe line upon the second bulkhead from the curved edge of the first bulkhead parallel with the first plane;

n) cutting the second bulkhead along the second scribe line to develop a curved edge of the second bulkhead;

o) locating a straight longitudinal edge of a second hull plate coincident with the curved edge of the second bulkhead and resting the second hull plate upon the curved edge of the first bulkhead;

p) cutting the second hull plate in proximity to its line of contact with the curved edge of the first bulkhead; and q) attaching the second hull plate to the curved edge of the second bulkhead and to the curved edge of the first bulkhead.

2. The method as set forth in claim 1 including the step of attaching a stern bulkhead.

3. The method a set forth in claim 1 including the step of adding gussets as a part of each of said steps of attaching.

4. The method as set forth in claim 1 including the step of using a jig to position the first bulkhead relative to the deck during exercise of said step of attaching the first bulkhead.

5. The method as set forth in claim 1 including repeating steps (a) to (q) to construct a mirror image hull and further including the step of attaching the second bulkheads of the two hulls to one another.

6. The method as set forth in claim 5 including the step of joining the two mirror image hulls with a spacer.

7. The method as set forth in claim 6 including the step of adding superstructure to the joined hulls.

8. The method as set forth in claim 1 wherein said step of attaching the gunnel includes the step of attaching the gunnel perpendicularly to the deck.

9. A boat hull constructed in accordance with a method comprising the steps of:

a) fabricating a deck having one straight longitudinal edge and a curved longitudinal edge;

b) forming a gunnel having a first straight longitudinal edge and a second longitudinal edge;

c) attaching the straight longitudinal edge of the gunnel to the curved longitudinal edge of the deck;

d) rotating the deck about its straight longitudinal edge disposed in a first plane to an angle of 45° with respect to the first plane;

e) attaching a straight longitudinal edge of a first longitudinal bulkhead to the straight longitudinal edge of the deck to locate the first bulkhead in a second plane perpendicular to the first plane;

f) projecting a first scribe line upon the first bulkhead from the second edge of the gunnel parallel with the first plane;

g) cutting the first bulkhead along the first scribe line to develop a curved edge of the first bulkhead;

h) locating a straight longitudinal edge of a first hull plate coincident with the curved edge of the first bulkhead and resting the first hull plate upon the second edge of the gunnel;

i) cutting the first hull plate in proximity to its line of contact with the second edge of the gunnel;

j) attaching the first hull plate to the curved edge of the first bulkhead and to the second edge of the gunnel;

k) rotating the deck about its straight longitudinal edge disposed in the first plane to a position coincident with the first plane;

l) attaching a straight longitudinal edge of a second longitudinal bulkhead to the straight longitudinal edge of the deck to locate the second bulkhead in a second plane perpendicular to the first plane;

m) projecting a second scribe line upon the second bulkhead from the curved edge of the first bulkhead parallel with the first plane;

n) cutting the second bulkhead along the second scribe line to develop a curved edge of the second bulkhead;

o) locating a straight longitudinal edge of a second hull plate coincident with the curved edge of the second bulkhead and resting the second hull plate upon the curved edge of the first bulkhead;

p) cutting the second hull plate in proximity to its line of contact with the curved edge of the first bulkhead; and q) attaching the second hull plate to the curved edge of the second bulkhead and to the curved edge of the first bulkhead.

10. The method as set forth in claim 9 including the step of attaching a stern bulkhead.

11. The method as set forth in claim 9 including the step of adding gussets as a part of each of said steps of attaching.

12. The method as set forth in claim 9 wherein said step of attaching the gunnel includes the step of attaching the gunnel perpendicularly to the deck.

13. A method for constructing a boat hull, said method comprising the steps of:

a) fabricating a deck having one straight longitudinal edge and a curved longitudinal edge;
b) securing a straight longitudinal edge of a longitudinal hull plate to the curved edge of the deck, which hull plate includes a second longitudinal edge;
c) rotating the deck about its longitudinal edge disposed in a first plane to a predetermine angle with respect to the first plane;
d) attaching a straight longitudinal edge of a longitudinal bulkhead to the straight longitudinal edge of the deck to locate the bulkhead in a second plane perpendicular to the first plane;
e) projecting a scribe line upon the bulkhead from the second longitudinal edge of the hull plate;
f) cutting the bulkhead along the scribe line to develop a curved edge of the bulkhead;
g) locating a straight longitudinal edge of a further hull plate coincident with the curved edge of the bulkhead and resting the further hull plate upon the second edge of the hull plate;
h) cutting the further hull plate in proximity to its line of contact with the second edge of the hull plate;
i) attaching the further hull plate to the curved edge of the bulkhead and to the second edge of the hull plate; and
j) repeating steps (c) to (i) until all hull plates have been attached.

14. The method as set forth in claim 13 including the step of attaching a stern bulkhead.

15. The method as set forth in claim 13 including the step of adding gussets as a part of each said step of attaching.

16. A boat hull constructed in accordance with a method comprising the steps of:

a) fabricating a deck having one straight longitudinal edge and a curved longitudinal edge;
b) securing a straight longitudinal edge of a longitudinal hull plate to the curved edge of the deck, which hull plate includes a second longitudinal edge;
c) rotating the deck about its longitudinal edge disposed in a first plane to a predetermined angle with respect to the first plane;
d) attaching a straight longitudinal edge of a longitudinal bulkhead to the straight longitudinal edge of the deck to locate the bulkhead in a second plane perpendicular to the first plane;
e) projecting a scribe line upon the bulkhead from the second longitudinal edge of the hull plate;
f) cutting the bulkhead along the scribe line to develop a curved edge of the bulkhead;
g) locating a straight longitudinal edge of a further hull plate coincident with the curved edge of the bulkhead and resting the further hull plate upon the second edge of the hull plate;
h) cutting the further hull plate in proximity to its line of contact with the second edge of the hull plate;
i) attaching the further hull plate to the curved edge of the bulkhead and to the second edge of the hull plate; and
j) repeating steps (c) to (i) until all hull plates have been attached.

17. The method as set forth in claim 16 including the step of attaching a stern bulkhead.

18. The method as set forth in claim 16 including the step of adding gussets as a part of each said step of attaching.

19. A method for constructing a boat hull, said method comprising the steps of:

a) fabricating a deck having a straight longitudinal center line and at least one curved longitudinal edge;
b) securing a straight longitudinal edge of a longitudinal hull plate to at least one curved edge of the deck, which hull plate includes a second longitudinal edge;
c) rotating the deck about its longitudinal center line disposed in a first plane to a predetermined angle with respect to the first plane;
d) attaching a straight longitudinal edge of a longitudinal bulkhead to the longitudinal centerline of the deck to locate the bulkhead in a second plane angled with respect to the first plane;
e) projecting a scribe line upon the bulkhead from the second longitudinal edge of the hull plate;
f) cutting the bulkhead along the scribe line to develop a curved edge of the bulkhead;
g) locating a straight longitudinal edge of a further hull plate coincident with the curved edge of the bulkhead and resting the further hull plate upon the second edge of the hull plate;
h) cutting the further hull plate in proximity to its line of contact with the second edge of the hull plate;
i) attaching the further hull plate to the curved edge of the bulkhead and to the second edge of the hull plate; and
j) repeating steps (c) to (i) until all hull plates to be attached have been attached.

20. The method as set forth in claim 19 including the step of attaching a stern bulkhead.

21. The method as set forth in claim 19 including the step of adding gussets as a part of each step of attaching.

22. The method as set forth in claim 19 wherein the deck includes a second curved longitudinal edge and including the steps of:

a) terminating said steps of repeating when the hull plates extend from the at least one curved edge of the deck to a plane extending through the centerline of the deck perpendicular to the deck;
b) securing a straight longitudinal edge of a second longitudinal hull plate to the second curved edge of the deck, which second hull plate includes a second longitudinal edge;
c) rotating the deck about its longitudinal center line disposed in the first plane to a predetermined angle with respect to the first plane;
d) attaching a straight longitudinal edge of a second longitudinal bulkhead to the longitudinal centerline of the deck to locate the bulkhead in a second plane angled with respect to the first plane;
3) projecting a scribe line upon the second bulkhead from the second longitudinal edge of the second hull plate;

f) cutting the second bulkhead along the scribe line to develop a curved edge of the second bulkhead;

g) locating a straight longitudinal edge of a further second hull plate coincident with the curved edge of the second bulkhead and resting the further second hull plate upon the second edge of the second hull plate;

h) cutting the further second hull plate in proximity to its line of contact with the second edge of the second hull plate;

i) attaching the further second hull plate to the curved edge of the second bulkhead and to the second edge of the second hull plate; and j) repeating steps (c) to (h) until the second hull plates extend from the second curved edge of the deck to a plane extending through the centerline of the deck perpendicular to the deck.

23. The method as set forth in claim 22 including the step of attaching a stern bulkhead.

24. The method as set forth in claim 22 including the step of adding gussets as a part of each said step of attaching.

25. A boat hull constructed in accordance with a method comprising the steps of:

a) fabricating a deck having a straight longitudinal center line and at least one curved longitudinal edge;

b) securing a straight longitudinal edge of a longitudinal hull plate to at least one curved edge of the deck, which hull plate includes a second longitudinal edge;

c) rotating the deck about its longitudinal center line disposed in a first plane to a predetermined angle with respect to the first plane;

d) attaching a straight longitudinal edge of a longitudinal bulkhead to the longitudinal centerline of the deck to locate the bulkhead in a second plane angled with respect to the first plane;

e) projecting a scribe line upon the bulkhead from the second longitudinal edge of the hull plate;

f) cutting the bulkhead along the scribe lien to develop a curved edge of the bulkhead;

g) locating a straight longitudinal edge of a further hull plate coincident with the curved edge of the bulkhead and resting the further hull plate upon the second edge of the hull plate;

h) cutting the further hull plate in proximity to its line of contact with the second edge of the hull plate;

i) attaching the further hull plate to the curved edge of the bulkhead and to the second edge of the hull plate; and j) repeating steps (c) to (i) until all of the hull plates to be attached have been attached.

26. The method as set forth in claim 25 wherein the deck includes a second curved longitudinal edge and including the steps of:

a) terminating said steps of repeating when the hull plates extend from the at least one curved edge of the deck to a plane extending through the centerline of the deck perpendicular to the deck;

b) securing a straight longitudinal edge of a second longitudinal hull plate to the second curved edge of the deck, which second hull plate includes a second longitudinal edge;

c) rotating the deck about its longitudinal center line disposed in the first plane to a predetermined angle with respect to the first plane;

d) attaching a straight longitudinal edge of a second longitudinal bulkhead to the longitudinal centerline of the deck to locate the bulkhead in a second plane angled with respect to the first plane;

e) projecting a scribe line upon the second bulkhead from the second longitudinal edge of the second hull plate;

f) cutting the second bulkhead along the scribe line to develop a curved edge of the second bulkhead;

g) locating a straight longitudinal edge of a further second hull plate coincident with the curved edge of the second bulkhead and resting the further second hull plate upon the second edge of the second hull plate;

h) cutting the further second hull plate in proximity to its line of contact with the second edge of the second hull plate;

i) attaching the further second hull plate to the curved edge of the second bulkhead and to the second edge of the second hull plate; and j) repeating steps (c) to (h) until the second hull plates extend from the second curved edge of the deck to a plane extending through the centerline of the deck perpendicular to the deck.

* * * * *